US005387114A

United States Patent [19]

Brunker et al.

[11] Patent Number: 5,387,114

[45] Date of Patent: Feb. 7, 1995

[54] ELECTRICAL CONNECTOR WITH MEANS FOR ALTERING CIRCUIT CHARACTERISTICS

[75] Inventors: David L. Brunker, Naperville; Richard A. Nelson, Glen Ellyn, both of Ill.

[73] Assignee: Molex Incorporated, Lisle, Ill.

[21] Appl. No.: 95,890

[22] Filed: Jul. 22, 1993

[51] Int. Cl.[6] ..... H01R 4/66

[52] U.S. Cl. ..... 439/108; 29/842

[58] Field of Search ..... 439/95, 108, 608, 609, 439/620; 29/842

[56] References Cited

U.S. PATENT DOCUMENTS

| | | | |
|---|---|---|---|
| 4,641,908 | 2/1987 | Steffinger | 339/206 R |
| 4,836,791 | 6/1989 | Grabbe et al. | 439/79 |
| 4,986,772 | 1/1991 | Fukutani | 439/892 |
| 5,035,651 | 7/1991 | Dixon et al. | 439/609 |
| 5,066,236 | 11/1991 | Broeksteeg | 439/79 |
| 5,102,353 | 4/1992 | Brunker et al. | 439/608 |
| 5,104,341 | 4/1992 | Gilissen et al. | 439/608 |

FOREIGN PATENT DOCUMENTS 64-19686 1/1989 Japan ..... H01R 13/648

*Primary Examiner*—Eugene F. Desmond
*Attorney, Agent, or Firm*—Charles S. Cohen

[57] ABSTRACT

A right-angled electrical connector includes a dielectric housing having a front mating face and rear face with a plurality of terminal-receiving passages extending therebetween. A plurality of terminals have forwardly projecting contact portions in the passages and right-angled tail portions projecting rearwardly from the housing. At least a first tail portion is longer than a second tail portion, whereby their respective terminals have circuit paths of different lengths. A ground plate extends alongside of and spaced from the first and second tail portions. A dielectric member is located between the ground plate and one of the first and second tail portions for controlling a circuit characteristic of the circuit path through the terminal of which the one tail portion is a part.

20 Claims, 2 Drawing Sheets

ELECTRICAL CONNECTOR WITH MEANS FOR ALTERING CIRCUIT CHARACTERISTICS

FIELD OF THE INVENTION

This invention generally relates to the art of electrical connectors and, particularly, to an electrical connector system which includes means for altering the dielectric constant of the electrical environment for terminals of differing lengths to control the impedance or the propagation delay of selected ones of the terminals.

BACKGROUND OF THE INVENTION

With the continuing trend toward compact electronic apparatus, there is an ever-increasing demand for miniaturized interconnection systems between the electronic components of the apparatus. An example is in computer apparatus wherein there is a constant demand to reduce the thickness or height parameters of the electronic components. With the components mounted on a printed circuit board, the height parameters relate to the distance above the board in which desired interconnections are made and which constantly are being reduced. One type of electrical connector used in such applications is a right-angled connector which has a mating axis generally parallel to the printed circuit board, and with a plurality of terminals having right-angled tail portions projecting from the connector generally parallel to the board and then downwardly perpendicular to the board for interconnection with circuit traces on the board.

An example of the use of such electrical connectors is to interconnect signal transmission lines to printed circuit boards, other electronic devices or to other complementary connectors. The transmission lines transmit signals through a plurality of conductors which, preferably, are physically separated and electromagnetically isolated along their length. In the electronics industry, particularly the computer industry, the predominant system embodies a plurality of plug-in type connectors in mating engagement with receptacle connectors on the computer, its main printed circuit board or other electronic devices. One of the connectors often is a right-angled connector, as described above. The transmission lines typically include coaxial electrical cables, either in round or flat form, and round cables presently are being used predominantly in relatively high frequency applications between various system components.

Classical coaxial designs derive their characteristic impedance from the geometrical relationship between the inner signal conductors and an outer shield member and an intervening dielectric constant. For a given impedance, signal conductor size and dielectric material, an overall outside dimension is defined. The circuit characteristics along equal lengths of such conductors should be identical. In order to increase signal density and reduce the overall outside dimensions of a transmission line connector system, alternate geometries and/or dielectric systems are required.

When using a right-angled electrical connector in systems described above, problems are encountered because of the unequal lengths of the tail portions of the connector terminals and, therefore, the unequal circuit path lengths through the terminals. For instance, a typical right-angled connector has two rows of terminals running generally parallel to a printed circuit board, with tail portions of the terminals projecting from the connector housing and then downwardly for interconnection with circuit traces on the board. Obviously, the tail portions of the upper row of terminals are longer than the tail portions of the lower row of terminals. Consequently, in any given pair of terminals taken from both the upper and lower rows, unequal circuit path lengths are created through those terminals. The different path lengths result in different circuit characteristics. In particular, assuming that the regional dielectric constant is the same for both terminals and the connector exhibits a varying and non-homogenous impedance characteristic through its mated electrical path length, the terminal with the longer tail portion will create a different impedance characteristic in its circuit than the terminal with the shorter tail portion.

Although this is the general case, typically, when impedance correction is desired, it would be most commonly used to decrease the impedance of the longer tail portion. This is the more common case since most contact mating regions are more substantial in relative conductive plate areas than are the corresponding tail section, therefore exhibiting greater capacitive coupling and a reduced characteristic impedance. In this situation, one would typically seek to reduce the impedance of the longest tail section to bring it closer to the lower composite impedance provided by the contact mating region and shorter tail portion.

In the alternative, given a mating area with reduced capacitive coupling, one could reduce the impedance of the shorter tail section to bring it closer to a lower composite impedance yielded by a higher impedance contact mating region weighted by a lower impedance along the length of a longer tail portion. The terminal with the longer tail portion also will have a higher propagation delay than the terminal with the shorter tail portion (i.e. the propagation rate through the shorter tail portion is faster).

This invention is directed to solving the problems outlined above by provided a system in which such circuit characteristics as impedance and propagation delay can be altered in a very simple manner, particularly in a right-angled electrical connector.

SUMMARY OF THE INVENTION

An object, therefore, of the invention is to provide an improved electrical connector having simple means for altering the characteristics of circuits therethrough.

In the exemplary embodiment of the invention, a right-angled electrical connector is illustrated with a dielectric-housing having a front mating face and a rear face with a plurality of terminal-receiving passages extending therebetween. A plurality of terminals have forwardly projecting contact portions in the passages and right-angled tail portions projecting rearwardly from the housing. At least a first one of the tail portions is longer than a second one of the tail portions, whereby their respective terminals have circuit paths of different lengths. A ground plate extends alongside of and spaced from the first and second tail portions. The invention contemplates that a dielectric member be located between the ground plate and one of the first and second tail portions for controlling a circuit characteristic of the circuit path through the terminal of which the one tail portion is a part.

The invention contemplates a system for controlling one of (a) the impedance and (b) the propagation delay circuit characteristics of the electrical connector. Specifically, the invention contemplates that the dielectric member be positioned alongside only one of the tail portions to alter the dielectric constant associated therewith depending on which of the circuit characteristics (a) and (b), above, is desired to be controlled. By positioning the dielectric member alongside the longer of the tail portions, the dielectric constant associated therewith will be increased and, thereby, the impedance of the circuit therethrough will be lowered and propagation delay increased. By positioning the dielectric member alongside the other or shorter of the tail portions, the dielectric constant associated therewith will be increased and, thereby, the propagation delay of the circuit therethrough will be increased and impedance decreased. By this system, a connector can be designed to better match the impedance or the propagation delay circuit characteristics of the electrical connector through the terminals of unequal lengths.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
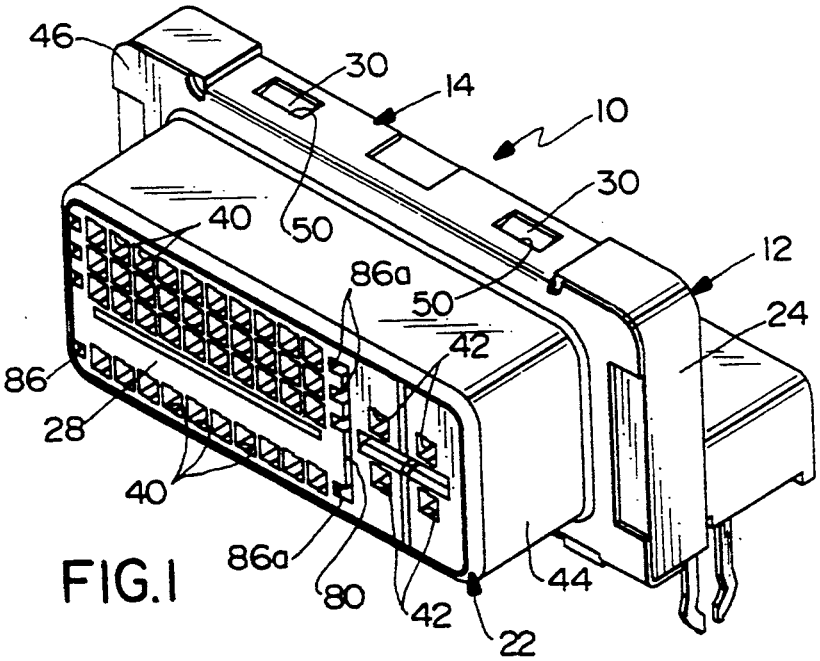
FIG. 1 is a perspective view of the front or mating side of an electrical connector embodying the concepts of the invention.
Figure 2:
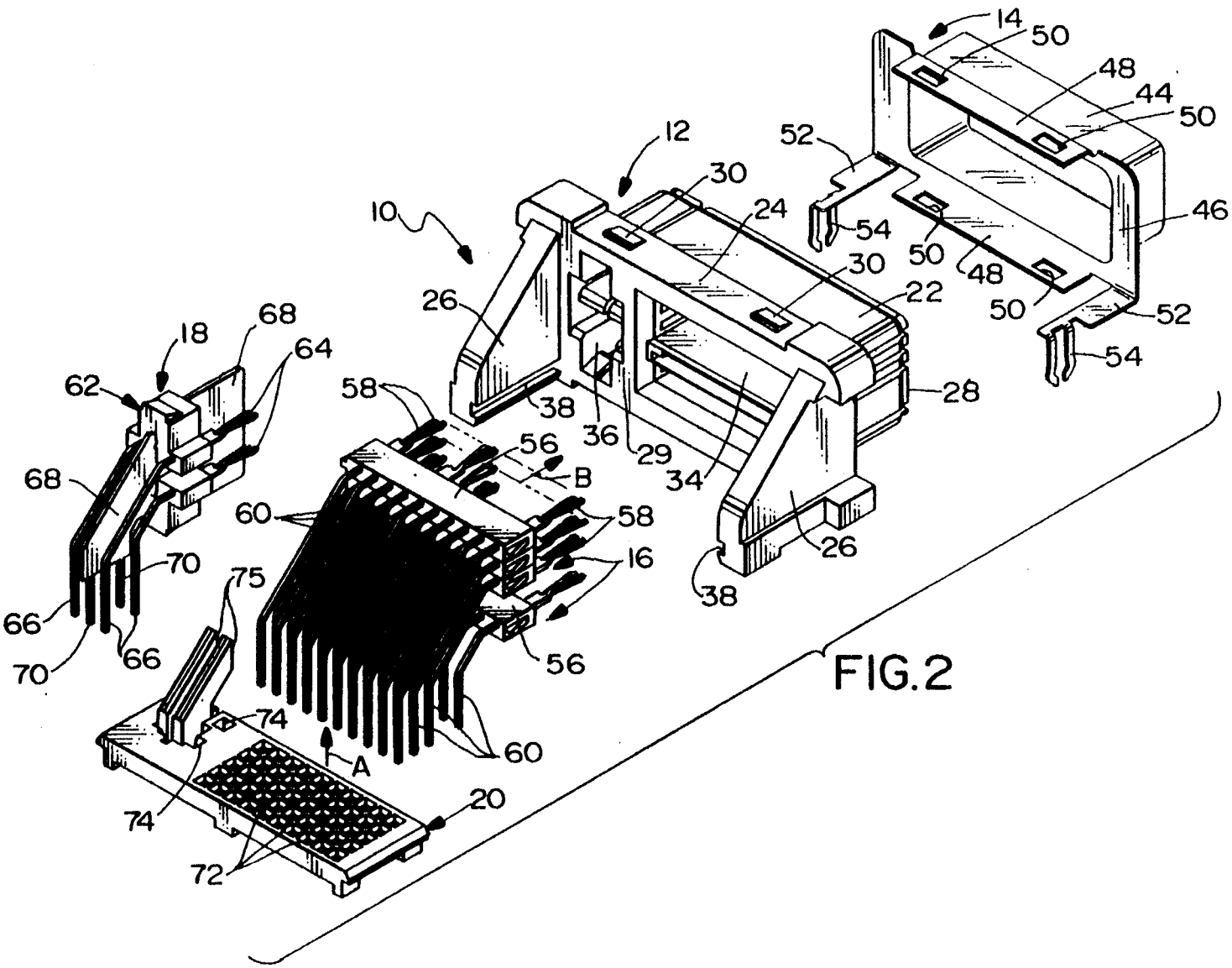
FIG. 2 is an exploded perspective view looking toward the rear side of the connector.

Referring to the drawings in greater detail, and first to FIGS. 1 and 2, the invention is embodied in a hybrid electrical connector, generally designated 10, for terminating both the conductors of slower data transmission lines and the conductors of high speed or high frequency transmission lines. More particularly, electrical connector 10 includes a dielectric housing, generally designated 12, a conductive shield, generally designated 14, data transmission terminal modules, generally designated 16 (FIG. 2), a high speed signal transmission terminal module, generally designated 18, and a tail aligning device, generally designated 20. The overall configuration of dielectric housing 12 and conductive shield 14 define a generally rectangular electrical connector.

Dielectric housing 12 includes a forwardly directed, generally rectangular mating portion 22 projecting forwardly from an enlarged, transversely outwardly projecting flange portion 24 as best seen in FIG. 2. A pair of triangulated side wings 26 project rearwardly from opposite sides of flange portion 24. Mating portion 22 defines a mating face 28 as best seen in FIG. 1. The housing has a rear face 29. The housing is unitarily molded of dielectric material such as plastic or the like, and a pair of ramped latch bosses 30 are molded integral with and project outwardly from both the top and bottom of flange portion 24 as seen in FIG. 2, for latching interengagement with conductive shield 14 as described hereinafter. A ramped latch boss 32 projects outwardly from each side wing 26 for latchingly engaging a complementary mating connector (not shown). As seen in FIG. 2, the rear of dielectric housing 12 includes a receptacle area 34 for receiving data transmission terminal modules 16, and an opening 36 for receiving high speed signal transmission terminal module 18. Grooves 38 are formed on the inside of side wings 26 for slidingly receiving tail aligning device 20. Lastly, as seen in FIG. 1, the front face 28 of mating portion 22 of the dielectric housing has a first array of passages 40 for receiving a plurality of lower speed data contacts or terminals from the complementary mating connector, and a second array of passages 42 for receiving a plurality of high speed signal contacts or terminals of the complementary connector.

Conductive shield 14 has a forwardly projecting, generally rectangularly shaped shroud portion 44 for surrounding mating portion 22 of dielectric housing 12, along with a peripheral face plate portion 46 for substantially covering the front surface of flange portion 24 of the housing. The shield has a pair of rearwardly projecting flanges 48, each flange having a pair of latch apertures 50 formed therein. A pair of legs 52 project rearwardly from opposite sides of peripheral face plate portion 46, each leg terminating in a bifurcated boardlock 54 which is insertable into an appropriate mounting hole in a printed circuit board and for interconnection with a ground circuit on the board or in the hole. The conductive shield is fabricated of stamped and formed sheet metal and is assembled to dielectric housing 12 as shown in FIG. 1, whereupon ramped latch bosses 30 snap into latching engagement within latch apertures 50 of the shield.

High speed signal transmission terminal modules 16 have elongated dielectric blocks 56 within which a plurality of data transmission terminals are insert molded. The data transmission terminals include contact or terminal portions 58 (FIG. 2) which project into the first array of passages 40 (FIG. 1). The data transmission terminals have tail portions 60 projecting from the rear of blocks 56 and angled downwardly at a right-angle to a mating axis of the connector perpendicular to mating face 28.

Generally, high speed signal transmission terminal module 18 includes a modular block construction, generally designated 62, for mounting a plurality of high speed signal terminals each having a forwardly projecting contact or terminal portion 64 (FIG. 2) projecting into a respective one of the second array of passages 42 (FIG. 1) in mating face 28 of the dielectric housing. The high speed signal transmission terminals have tail portions 66 projecting rearwardly and downwardly at a right-angle to the mating axis of the connector. As will be described in greater detail hereinafter, high speed signal transmission terminal module 18 includes a ground plate 68 located between two pairs of terminals of the signal transmission terminal module. The ground plate, itself, has tails 70 projecting downwardly therefrom.

Tails 60 of the terminals of data transmission modules 16, tails 66 of the signal terminals of high speed signal transmission terminal module 18 and tails 70 of ground plate 68 all are adapted for insertion into appropriate holes in a printed circuit board for solder connection to circuit traces on the board or in the holes. Therefore, tail aligning device 20 includes a first array of apertures 72 for receiving tails 60 of the data transmission terminals and a second array of apertures 74 for receiving tails 66 of the terminals of high speed signal transmission terminal block 18.

In assembly, tail aligning device 20 is assembled to terminal modules 16 and 18 by insertion of the tails of the terminals into apertures 72,74 as described above, and as indicated by arrow "A" in FIG. 2. This subassembly then is assembled to dielectric housing 12 in the direction of arrow "B" by inserting data transmission terminal modules 16 into receptacle area 34 and high speed signal transmission terminal module 18 into opening 36, as tail aligning device 20 slides within grooves 38 of the dielectric housing.

Figure 3:
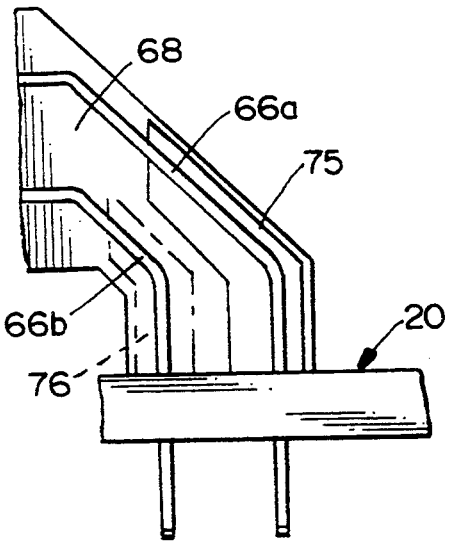
FIG. 3 is a fragmented, elevational view showing in full lines the position of one of the dielectric members alongside the longer tail portion of one of the terminals, and with the dielectric member shown in phantom alongside one of the shorter tail portions.
Figure 4:
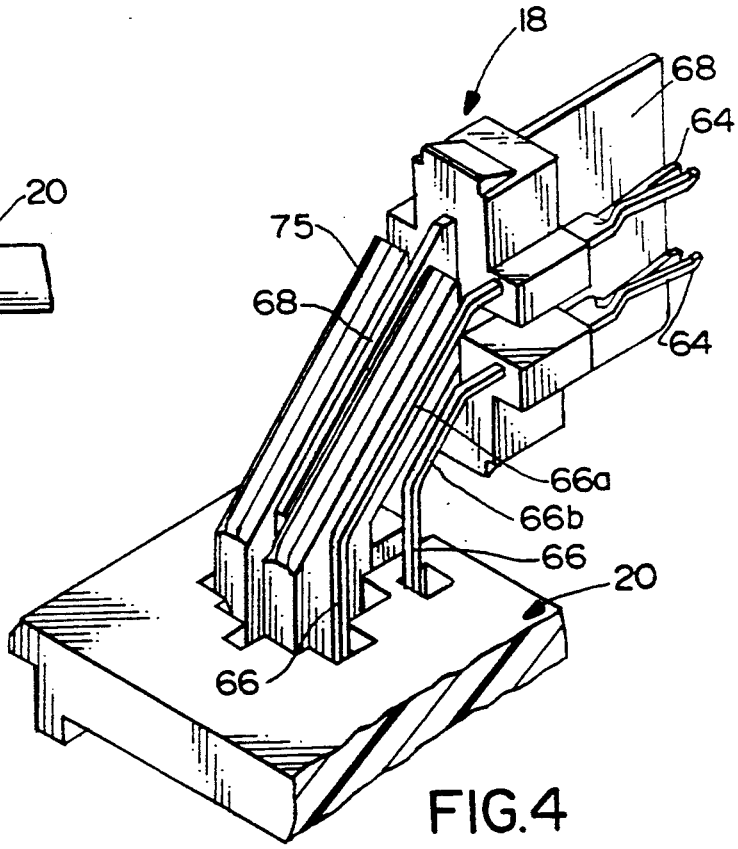
FIG. 4 is a fragmented perspective view looking toward the rear of the high speed signal transmission terminal module together with a portion of the tail aligning device.

Referring to FIG. 3 in conjunction with FIG. 2, the invention generally is directed to means for altering or modifying the dielectric constant associated with tail portions 66 (FIG. 2) of signal transmission terminal module 18 to control one of (a) the impedance or (b) the propagation delay circuit characteristics of the circuit paths through the terminals of the module. With connector 10 being a right-angled connector, the tail portions of the upper terminals are longer than the tail portions of the lower terminals as seen quite clearly in FIG. 3. Therefore, the longer tail portion is designated **66*a* and the shorter tail portion is designated 66*b* in FIG. 3** in order to present a clear and concise understanding of the invention, as described below.

Before proceeding, it should be understood that, with both the longer and shorter tail portions **66*a* and 66*b* (FIG. 3), respectively, surrounded by air, particularly between the tail portions and ground plate 68, the dielectric constant associated with and impedance for any given incremental length of the tail portions is equal. It also might be noted that the tail portions are spaced equidistant from ground plate 68. Under these circumstances or parameters, the impedance of an overall mated circuit through longer tail portion 66*a* given a non-homogeneous impedance through the mating section is different from the impedance of a circuit through shorter tail portion 66*b*. In addition, the propagation delay of a circuit through the longer tail portion 66*a* is greater than the propagation delay of a circuit through shorter tail portion 66*b***.

Both the impedance and the propagation delay circuit characteristics explained above are a function of the dielectric constant in the region of a conductor. The invention contemplates a novel system for altering those circuit characteristics in an electrical connector, such as right-angle connector 10, by a simple means for altering the dielectric constant in the region of one of the tail portions **66*a* or 66*b*. More particularly, FIGS. 2 and 3 show that tail aligning device 20 includes a pair of dielectric partitions 75 which are located on opposite sides of ground plate 68, between the ground plate and longer tail portions 66*a* on opposite sides of the ground plate. Tail aligning device 20 is unitarily molded of dielectric material, such as plastic, and partitions 75** are molded integrally therewith. It can be seen that the partitions are plate-like members and are disposed between the ground plate and the tail portions, rather than surrounding the tail portions, so that the partitions can move into position between the tail portions and the ground plate during assembly of the tail aligning device, as described above, notwithstanding the fact that the tail portions have angled bends therein.

According to the invention, if it is desired to control and/or match the impedance circuit characteristics of the circuits through the longer and shorter tail portions, dielectric partitions 75 are located as shown in full lines in FIG. 3 and described above. With dielectric partitions 75 being located alongside longer tail portions **66*a***, the dielectric constant associated with the longer tail portions is increased, versus the air otherwise present. When the dielectric constant is increased, the impedance is lowered, whereby the impedance of the longer tail portions can be reduced to better match or equalize the impedance of the circuits through the shorter tail portions.

On the other hand, if it is desired to control and/or match the propagation delay characteristics of the circuits through the longer and shorter tail portions, dielectric partitions 76 (as shown in phantom in FIG. 3) are located alongside shorter tail portions **66*b*** to increase the dielectric constant associated therewith. When the dielectric constant is increased, the propagation delay also is increased, whereby the rate of propagation in the shorter tail portions can be reduced to better match or equalize the propagation delay of the circuit through the longer tail portions. Simply put, the propagation of the circuit through the shorter tail portions is "slowed down" to match that of the longer tail portions.

In actual practice, given a typical mating area of lower impedance than the corresponding tail portion, if it is desired to design an electrical connector having a given impedance, and it is desired to equalize the impedance of the circuit paths through the terminals of the signal module, a connector or connector system would be designed so that the circuit path through the terminals having shorter tail portions **66*b* would be the desired or specified impedance. Dielectric partitions 75 then would be employed on tail aligning device 20 for positioning between longer tail portions 66*a* and ground plate 68** in order to equalize the impedance of the circuit paths through the terminals having different length tail portions.

On the other hand, if it is desired to design a connector in which the propagation delay of the circuits through the signal transmission terminals are of a given value and equalized, the connector or connector system would be designed so that the circuit through the transmission lines including the terminals with longer tail portions **66*a* would have the prescribed or specified propagation delay. Since the propagation delay through the shorter tail portion 66*b*, obviously, is less, dielectric partitions 76 would be employed on tail aligning device 20, rather than dielectric partitions 75. The dielectric partitions 76 will increase the dielectric constant of shorter tail portions 66*b*** and, in essence, "slow down" the propagation rate of the shorter tail portions to more substantially equalize or match that of the longer tail portions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A right-angled electrical connector, comprising:

a dielectric housing having a front mating face and a rear face with terminal-receiving passageway means extending therebetween;

a plurality of terminals, each having a forwardly projecting contact portion in said passageway means and a tail portion projecting rearwardly from the housing, said tail portion having a board mounting portion at an angle to said contact portion and a transition portion extending from said board mounting portion to said contact portion and including at least one bent region, a cross section of said tail portion being defined by four sides along the length thereof, at least a first of said tail portions being longer than a second of the tail portions whereby their respective terminals have circuit paths of different lengths;

a ground plate extending alongside of and spaced from a first side of both of said first and second tail portions; and a dielectric member located between the ground plate and a selected one of said first and second tail portions for controlling a circuit characteristic of the circuit path through the terminal of which said one tail portion is a part, said dielectric member extending along said first said first side of said selected tail portion and only air immediately adjacent a second side opposite said first side of said selected tail portion.

2. A right-angled electrical connector as set forth in claim 1, wherein said dielectric member is located between the ground plate and the first, longer tail portion for decreasing the impedance of the circuit path therethrough.

3. A right-angled electrical connector as set forth in claim 1, wherein said dielectric member is located between the ground plate and the second, shorter tail portion for increasing the propagation delay of a circuit therethrough.

4. A right-angled electrical connector as set forth in claim 1, including a tail aligning device having apertures therethrough for receiving the tail portions of the terminals, and said dielectric member extends in a cantilevered manner from the tail aligning device.

5. A right-angled electrical connector as set forth in claim 4, wherein said dielectric member comprises a plate-like member.

6. A right-angled electrical connector as set forth in claim 5, wherein said tail aligning device comprises a molded plastic component with the dielectric member integral therewith.

7. A right-angled electrical connector as set forth in claim 1, further comprising a one piece conductive ground shield having a generally rectangular shroud encircling the contact portions of the terminals.

8. A right-angled electrical connector as set forth in claim 1, wherein each terminal is a stamped and formed one piece member.

9. A right-angled electrical connector as set forth in claim 1, wherein said ground plate is generally planar and extends from adjacent said mating face to a location adjacent said bent region of said first tail portion.

10. In a right-angled electrical connector which includes a dielectric housing mounting at least a pair of terminals, each having a contact portion and a right-angled tail portion projecting therefrom, each said tail portion having a board mounting portion at an angle to said contact portion and a transition portion between said board mounting portion and said contact portion and including at least one bent region, the tail portion of one of said terminals being longer than the tail portion of the other, and a tail aligning device having apertures therethrough through which a portion of the board mounting portions extend, wherein the improvement comprises a plate-like dielectric member extending from the tail aligning device and alongside both a length of said board mounting portion and said bent region of said transition portion of one of the right-angled tail portions for controlling the relative dielectric constants of the region surrounding the tail portions.

11. In a right-angled electrical connector as set forth in claim 10, wherein said dielectric member extends alongside the longer of the tail portions for increasing the dielectric constant of the surrounding region and, thereby, decreasing the impedance of a circuit therethrough.

12. In a right-angled electrical connector as set forth in claim 10, wherein said dielectric member extends alongside the other of the tail portions for increasing the dielectric constant of the surrounding region and, thereby, increasing the propagation delay of a circuit therethrough.

13. In a right-angled electrical connector as set forth in claim 10, wherein said tail aligning device comprises a molded plastic component with the dielectric member integral therewith.

14. In a right-angled electrical connector as set forth in claim 10, further comprising a one piece conductive ground shield having a generally rectangular shroud encircling the contact portions of the terminals.

15. In a right-angled electrical connector as set forth in claim 10, wherein each terminal is a stamped and formed one piece member.

16. In a right-angled electrical connector as set forth in claim 10, further comprising a ground plate spaced from and extending along substantially the entire length of said pair of terminals and said dielectric member being positioned between one of said right-angled tail portions and said ground plate.

17. In a right-angled electrical connector as set forth in claim 16, wherein each terminal is a stamped and formed one piece member.

18. A system for preferentially controlling one of (a) the impedance and (b) the propagation delay circuit characteristics of an electrical connector which has a dielectric housing mounting at least a pair of stamped and formed terminals having tail portions projecting therefrom, one of the tail portions being longer than the other, and a ground member spaced from and extending along substantially the entire length of each of the terminals, comprising:

selectively positioning a dielectric member alongside only one of the tail portions and between said one of the tail portions and the ground member to alter the dielectric constant thereof depending on which of the characteristics (a) and (b), above, is desired to be preferentially controlled, whereby positioning the dielectric member alongside the longer of the tail portions will increase the dielectric constant thereof and, thereby, decrease the impedance of a circuit therethrough, and whereby positioning the dielectric member alongside the other of the tail portions will increase the dielectric constant thereof and, thereby, increase the propagation delay of a circuit therethrough.

19. In a right-angled, shielded I/O electrical connector which includes a dielectric housing mounting at least a pair of terminals, each having a contact portion and a right-angled tail portion projecting therefrom, each said tail portion having a board mounting portion generally perpendicular to said contact portion and a transition portion between said board mounting portion and said contact portion and including at least one bent region, the tail portion of one of said terminals being longer than the tail portion of the other, a ground plate spaced from and extending along said pair of terminals, a one piece conductive ground shield member having a generally rectangular shroud encircling the contact portions of the terminals and a tail aligning device having apertures through which a portion of the board mounting portions extends, wherein the improvement comprises:

said ground plate extending along substantially the entire length of said pair of terminals and a dielectric member integrally formed with and extending from the tail aligning device and alongside both a length of said board mounting portion and said bent region of said transition portion of one of the right-angled tail portions and positioned between said right-angled tail portion and said ground plate for controlling the relative dielectric constants of the region surrounding the tail portions.

20. In a right-angled, shielded I/O electrical connector as set forth in claim 19, wherein each terminal is a stamped and formed one piece member.

* * * * *